US010584860B2

(12) United States Patent
Dungan et al.

(10) Patent No.: US 10,584,860 B2
(45) Date of Patent: Mar. 10, 2020

(54) LINEAR LIGHT FIXTURE WITH INTERCHANGEABLE LIGHT ENGINE UNIT

(71) Applicant: CREE, INC., Durham, NC (US)

(72) Inventors: William Laird Dungan, Cary, NC (US); James Michael Lay, Apex, NC (US); Nathan Snell, Raleigh, NC (US); Gary David Trott, Eatonton, GA (US)

(73) Assignee: IDEAL INDUSTRIES, LLC, Sycamore, IL (US)

( * ) Notice: Subject to any disclaimer, the term of this patent is extended or adjusted under 35 U.S.C. 154(b) by 0 days.

(21) Appl. No.: 13/829,558

(22) Filed: Mar. 14, 2013

(65) Prior Publication Data

US 2014/0268720 A1 Sep. 18, 2014

(51) Int. Cl.
*F21V 23/02* (2006.01)
*F21S 8/02* (2006.01)

(52) U.S. Cl.
CPC ..... *F21V 23/026* (2013.01); *F21S 8/026* (2013.01)

(58) Field of Classification Search
CPC ..... F21K 9/175; F21K 9/30; F21V 23/026; F21V 15/015; F21V 23/0471; F21V 29/70; F21V 21/005; F21S 8/02; F21S 8/026; F21S 2/005
USPC ..... 362/217.1–217.17, 241, 243, 247, 346, 362/607, 249.06, 221, 147, 368, 217.01, 362/365, 374, 249.11
See application file for complete search history.

(56) References Cited

U.S. PATENT DOCUMENTS 4,118,763 A 10/1978 Osteen ..... 359/833
4,300,185 A 11/1981 Wakamatsu ..... 362/147
4,464,707 A 8/1984 Forrest ..... 362/271.06
(Continued)

FOREIGN PATENT DOCUMENTS

CN 1710323 A 12/2005
CN 101994939 A 3/2011
(Continued)

OTHER PUBLICATIONS

Office Action from U.S. Appl. No. 29/449,316, dated Jun. 5, 2014.
(Continued)

*Primary Examiner* — Arman B Fallahkhair
(74) *Attorney, Agent, or Firm* — Ferguson Case Orr Paterson

(57) ABSTRACT

A modular troffer-style fixture that is well-suited for use with solid state light sources, such as LEDs, to provide a surface ambient light (SAL). The fixture comprises two structural components: a housing subassembly and a lighting subassembly. These two subassemblies may be removably attached to operate as a singular fixture. Many different lighting subassemblies may be compatible with a single housing subassembly and vice versa. The housing subassembly comprises a body that is mountable to an external structure. The lighting subassembly comprises the light sources and optical elements that tailor the light to achieve a particular profile. Electronics necessary to power and control the light sources may be disposed in the housing subassembly, the lighting subassembly, or both. Various mount mechanisms may be used to attach the fixture to a surface such as a ceiling or a wall. Multiple fixtures can be connected serially to provide an extended continuous fixture.

33 Claims, 8 Drawing Sheets

(56) References Cited

U.S. PATENT DOCUMENTS 4,472,767 A 9/1984 Wenman ..... 362/147
4,946,547 A 8/1990 Palmour et al.
5,200,022 A 4/1993 Kong et al.
RE34,861 E 2/1995 Davis et al.
5,530,628 A 6/1996 Ngai ..... 362/127
5,690,415 A * 11/1997 Krehl ..... 362/125
5,823,663 A 10/1998 Bell et al.
5,907,218 A 5/1999 Altman et al.
5,951,150 A 9/1999 Helstern ..... 362/293
6,210,025 B1 4/2001 Schmidt et al.
6,435,697 B1 8/2002 Simmons ..... 362/219
6,536,924 B2 * 3/2003 Segretto ..... 362/345
6,659,622 B2 * 12/2003 Katogi ..... F21S 2/00 315/219
6,667,451 B1 12/2003 Hart ..... 200/314
6,739,734 B1 5/2004 Hulgan ..... 362/243
6,752,513 B2 * 6/2004 Plunk ..... F21S 8/02 362/148
6,914,194 B2 7/2005 Fan
7,131,747 B1 11/2006 Yates ..... 362/219
7,213,940 B1 5/2007 Van de Ven et al.
7,217,023 B2 5/2007 Iwasa et al. ..... 362/555
7,228,253 B2 6/2007 Chen ..... 318/11
7,267,461 B2 * 9/2007 Kan ..... F21V 5/002 362/373
7,303,310 B2 * 12/2007 You ..... F21S 8/031 362/219
7,387,410 B2 * 6/2008 Sibout ..... 362/375
7,520,636 B2 * 4/2009 Van Der Poel ..... F21V 7/0008 362/290
7,540,627 B2 6/2009 Handsaker ..... 362/225
7,559,672 B1 7/2009 Parkyn et al.
7,591,578 B2 * 9/2009 Chang ..... G02F 1/133602 362/612
7,628,506 B2 * 12/2009 Verfuerth et al. ..... 362/218
7,654,703 B2 * 2/2010 Kan ..... F21S 48/328 362/218
7,674,005 B2 * 3/2010 Chung ..... F21S 8/02 362/147
7,722,220 B2 5/2010 Van De Ven et al.
7,758,207 B1 7/2010 Zhou ..... 362/217.1
7,791,061 B2 9/2010 Edmond et al.
8,058,088 B2 11/2011 Cannon et al.
8,206,004 B2 * 6/2012 Serak et al. ..... 362/217.13
8,220,953 B1 7/2012 Moore ..... 362/217.01
8,313,212 B1 11/2012 Mayer et al. ..... 362/219
8,317,369 B2 * 11/2012 McCanless ..... 362/368
8,342,714 B1 1/2013 Rea ..... 362/264
8,360,599 B2 * 1/2013 Ivey ..... F21V 23/06 362/218
8,376,578 B2 * 2/2013 Kong, II ..... F21V 23/06 362/241
8,388,180 B2 3/2013 Chang et al.
8,459,824 B1 6/2013 Esmailzadeh et al. ..... 362/147
8,523,383 B1 9/2013 Grigore et al. ..... 362/221
8,678,611 B2 * 3/2014 Chu ..... F21K 9/17 313/110
8,714,770 B2 5/2014 Kato ..... 362/217.06
8,764,220 B2 7/2014 Chan et al. ..... 362/217.02
8,777,448 B2 * 7/2014 Shimizu ..... F21K 9/30 362/235
8,888,314 B2 * 11/2014 Gill ..... F21V 15/015 362/218
9,057,493 B2 6/2015 Simon
2001/0048599 A1 12/2001 Hess ..... 362/290
2004/0240214 A1 12/2004 Whitlow et al. ..... 362/373
2004/0252521 A1 12/2004 Clark ..... 362/554
2005/0041418 A1 2/2005 Fan ..... 362/217.05
2005/0146867 A1 7/2005 Kassay ..... 362/217.05
2006/0050505 A1 * 3/2006 McCarthy et al. ..... 362/219
2006/0266955 A1 11/2006 Arvin ..... 250/492.1
2006/0278882 A1 12/2006 Leung ..... 257/98
2007/0109330 A1 5/2007 Brown Elliott et al.
2007/0158668 A1 7/2007 Tarsa et al.
2007/0171647 A1 7/2007 Artwohl et al.
2008/0128723 A1 6/2008 Pang
2008/0173884 A1 7/2008 Chitnis et al.
2008/0179611 A1 7/2008 Chitnis et al.
2008/0258130 A1 10/2008 Bergmann et al.
2008/0285267 A1 11/2008 Santoro ..... 362/224
2008/0314944 A1 12/2008 Tsai ..... 224/331
2009/0009999 A1 1/2009 Wang
2009/0040782 A1 2/2009 Liu et al. ..... 362/555
2009/0046457 A1 2/2009 Everhart ..... 362/235
2009/0161356 A1 6/2009 Negley et al. ..... 362/231
2009/0184333 A1 7/2009 Wang et al.
2009/0185379 A1 7/2009 Chen
2009/0207602 A1 8/2009 Reed et al. ..... 362/225
2009/0212304 A1 8/2009 Wang et al.
2009/0224265 A1 9/2009 Wang et al.
2009/0290345 A1 11/2009 Shaner ..... 362/249.01
2009/0290348 A1 11/2009 Van Laanen et al. ..... 362/249
2009/0296381 A1 12/2009 Dubord ..... 362/218
2010/0002426 A1 1/2010 Wu ..... 362/223
2010/0014289 A1 1/2010 Thomas ..... 362/235
2010/0110701 A1 5/2010 Liu ..... 362/373
2010/0128485 A1 5/2010 Teng ..... 362/294
2010/0142205 A1 6/2010 Bishop ..... 362/249.02
2010/0155763 A1 6/2010 Donofrio et al.
2010/0171404 A1 7/2010 Liu et al. ..... 313/46
2010/0214770 A1 8/2010 Anderson ..... 362/133
2010/0220469 A1 9/2010 Ivey et al. ..... 362/218
2010/0259927 A1 10/2010 Chien ..... 362/235
2010/0328945 A1 12/2010 Song et al. ..... 362/240
2011/0006688 A1 1/2011 Shim ..... 315/119
2011/0007514 A1 1/2011 Sloan ..... 362/368
2011/0013400 A1 1/2011 Kanno et al.
2011/0028006 A1 2/2011 Shah et al. ..... 439/39
2011/0090682 A1 4/2011 Zheng ..... 362/218
2011/0103043 A1 5/2011 Ago ..... 362/147
2011/0163683 A1 7/2011 Steele et al. ..... 315/192
2011/0211330 A1 9/2011 Wang ..... 362/20
2011/0285314 A1 11/2011 Carney et al. ..... 315/294
2011/0286207 A1 11/2011 Chan et al. ..... 362/217.1
2011/0286208 A1 11/2011 Chen ..... 362/217.1
2011/0310604 A1 * 12/2011 Shimizu et al. ..... 362/235
2011/0310614 A1 12/2011 Budike, Jr. ..... 362/294
2012/0002408 A1 1/2012 Lichten et al. ..... 362/218
2012/0051041 A1 * 3/2012 Edmond ..... F21S 8/026 362/231
2012/0075857 A1 3/2012 Verbrugh ..... 362/249
2012/0081883 A1 4/2012 Wang ..... 362/101
2012/0092876 A1 4/2012 Chang et al.
2012/0098424 A1 4/2012 Arik ..... 315/35
2012/0120666 A1 5/2012 Moeller ..... 362/308
2012/0169234 A1 7/2012 Shew ..... 315/88
2012/0182755 A1 7/2012 Wildner ..... 362/555
2012/0201023 A1 8/2012 Yoneda
2012/0218757 A1 8/2012 Gill ..... 362/235
2012/0235199 A1 9/2012 Andrews et al.
2012/0250302 A1 10/2012 Edwards ..... 362/223
2013/0021803 A1 * 1/2013 Pickard ..... F21V 7/22 362/308
2013/0039090 A1 2/2013 Dau ..... 362/551
2013/0050998 A1 2/2013 Chu et al. ..... 362/218
2013/0093359 A1 4/2013 Hsu et al.
2013/0094225 A1 4/2013 Leichner ..... 362/368
2013/0155670 A1 6/2013 Handsaker ..... 362/223
2013/0242548 A1 9/2013 Ter-Hovhannisyan
2013/0258616 A1 10/2013 Chao
2013/0271979 A1 10/2013 Pearson et al. ..... 362/235
2013/0279156 A1 10/2013 Kaule ..... 362/133
2013/0279180 A1 10/2013 Pearson et al. ..... 362/371
2013/0329425 A1 12/2013 Lowes et al.
2014/0043802 A1 2/2014 Dings
2014/0085861 A1 3/2014 Nicolai ..... 362/84
2014/0265809 A1 9/2014 Hussell
2014/0313731 A1 10/2014 Kwak
2015/0016100 A1 1/2015 Ishii ..... 362/223
2015/0022999 A1 1/2015 Yu et al.
2016/0025278 A1 1/2016 Camarota

(56) References Cited

U.S. PATENT DOCUMENTS

FOREIGN PATENT DOCUMENTS

| | | | |
|---|---|---|---|
| CN | 1019844284 | 3/2011 | |
| DE | WO2008003289 | 1/2008 | ..... F21S 4/003 |
| KR | 20100012997 | 12/2010 | |

OTHER PUBLICATIONS

Office Action from U.S. Appl. No. 13/842,150, dated Jun. 18, 2014.
Leviton LED Magnetic Tube Retrofit Series datasheet, 1 page. from www.leviton.com.
U.S. Appl. No. 13/649,052, filed Oct. 10, 2012, Lowes, et al.
U.S. Appl. No. 13/649,067, filed Oct. 10, 2012, Lowes, et al.
U.S. Appl. No. 13/770,389, filed Feb. 19, 2013, Lowes, et al.
U.S. Appl. No. 13/782,820, filed Mar. 1, 2013, Dixon, et al.
U.S. Appl. No. 12/873,303, filed Aug. 31, 2010, Edmond, et al.
CircalokTM conductive adhesive. 6972 and 6968, by Lord Corporation, 2 pages.
Office Action from U.S. Appl. No. 29/450,283, dated Nov. 5, 2014.
Office Action from U.S. Appl. No. 29/449,316, dated Nov. 26, 2014.
Office Action from U.S. Appl. No. 13/840,812, dated Nov. 28, 2014.
Office Action from U.S. Appl. No. 13/763,270, dated Oct. 3, 2014.
Restriction Requirement from U.S. Appl. No. 13/839,130, dated Jul. 28, 2014.
Office Action from U.S. Appl. No. 13/839,130, dated Sep. 25, 2014.
Office Action from U.S. Appl. No. 13/672,592, dated Jan. 7, 2015.
Office Action from U.S. Appl. No. 13/899,314, dated Jan. 15, 2015.
Office Action from U.S. Appl. No. 13/842,150, dated Jan. 22, 2015.
Office Action from U.S. Appl. No. 13/958,462, dated Mar. 10, 2015.
Office Action from U.S. Appl. No. 13/834,605, dated Apr. 9, 2015.
Office Action from U.S. Appl. No. 13/840,012, dated May 12, 2015.
Office Action from U.S. Appl. No. 13/910,486, dated May 7, 2015.
Office Action from U.S. Appl. No. 13/763,270, dated May 19, 2015.
Office Action from U.S. Appl. No. 14/252,685, dated Oct. 1, 2015.
Office Action from U.S. Appl. No. 13/958,461, dated Oct. 15, 2015.
Office Action from U.S. Appl. No. 13/910,486, dated Oct. 15, 2015.
Response to OA from U.S. Appl. No. 13/910,486, filed Dec. 15, 2015.
Office Action from U.S. Appl. No. 13/782,820, dated Oct. 30, 2015.
Office Action from U.S. Appl. No. 13/899,314, dated Nov. 13, 2015.
Response to OA from U.S. Appl. No. 13/899,314, filed Dec. 16, 2015.
Office Action from U.S. Appl. No. 13/672,592, dated Nov. 23, 2015.
Office Action from U.S. Appl. No. 14/020,750, dated Dec. 14, 2015.
Office Action from U.S. Appl. No. 13/899,314, dated Jul. 29, 2015.
Response to OA from U.S. Appl. No. 13/899,314, filed Sep. 15, 2015.
Office Action from U.S. Appl. No. 13/672,592, dated Aug. 6, 2015.
Response to OA from U.S. Appl. No. 13/672,592, filed Sep. 21, 2015.
Office Action from U.S. Appl. No. 13/842,150, dated Aug. 10, 2015.
Office Action from U.S. Appl. No. 14/108,168; dated Dec. 24, 2015.
Office Action from U.S. Appl. No. 13/842,150; dated Dec. 30, 2015.
Office Action from U.S. Appl. No. 13/763,270; Jan. 12, 2016.
Office Action from U.S. Appl. No. 13/899,314; dated Feb. 4, 2016.
Office Action from U.S. Appl. No. 14/070,098; dated Feb. 5, 2016.
Office Action for U.S. Appl. No. 13/958,461; dated Jun. 17, 2016.
Office Action for U.S. Appl. No. 13/910,486; dated Jun. 23, 2016.
Office Action for U.S. Appl. No. 13/763,270; dated Jul. 15, 2016.
Office Action from U.S. Appl. No. 13/910,486; dated Mar. 1, 2016.
Office Action from U.S. Appl. No. 14/108,168; dated May 20, 2016.
Office Action from U.S. Appl. No. 14/252,685; dated May 20, 2016.
Office Action from U.S. Appl. No. 14/020,750; dated Jul. 20, 2016.
Office Action from U.S. Appl. No. 14/070,098; dated Sep. 9, 2016.
Chinese Office Action Application No. 201310236572; dated Jan. 4, 2017.
Office Action for U.S. Appl. No. 14/020,750; dated Jan. 25, 2017.
Office Action for U.S. Appl. No. 14/252,685; dated Oct. 20, 2017.
Office Action for U.S. Appl. No. 14/070,098; dated Oct. 23, 2017.
Office Action for U.S. Appl. No. 14/108,168; dated Nov. 2, 2017.
Search Report for Chinese Application No. 2013101236572; dated Jan. 22, 2018.
Fourth Office Action for Chinese Application No. 2013101236572; dated Jan. 30, 2018.
Office Action for U.S. Appl. No. 13/910,486; dated Feb. 5, 2018.
Office Action for U.S. Appl. No. 13/763,270; dated Mar. 10, 2018.
Office Action for U.S. Appl. No. 14/108,168; dated Mar. 22, 2018.
Office Action for U.S. Appl. No. 13/910,486; dated Jun. 29, 2018.
Office Action for U.S. Appl. No. 14/070,098; dated Jun. 28, 2018.

* cited by examiner

FIG. 1
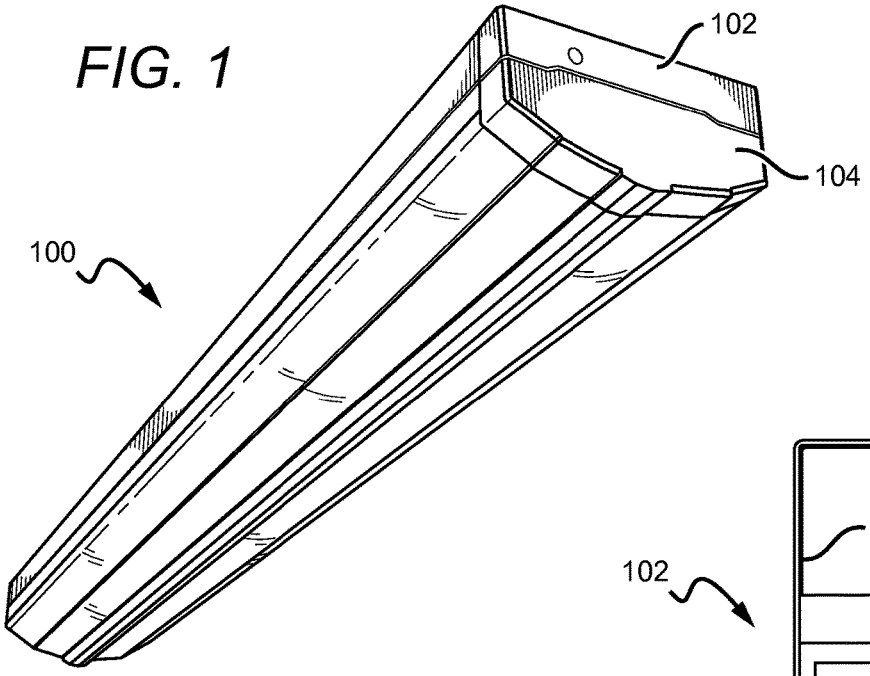
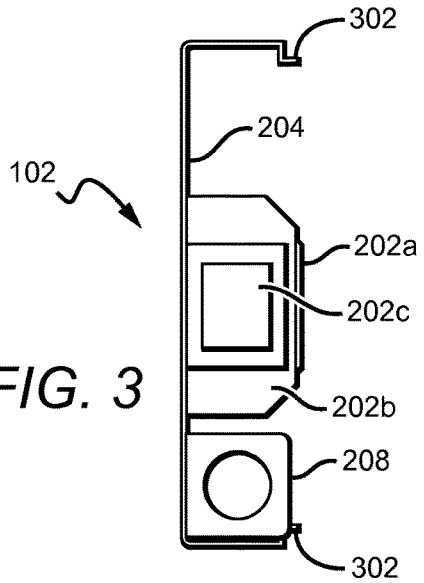
FIG. 3
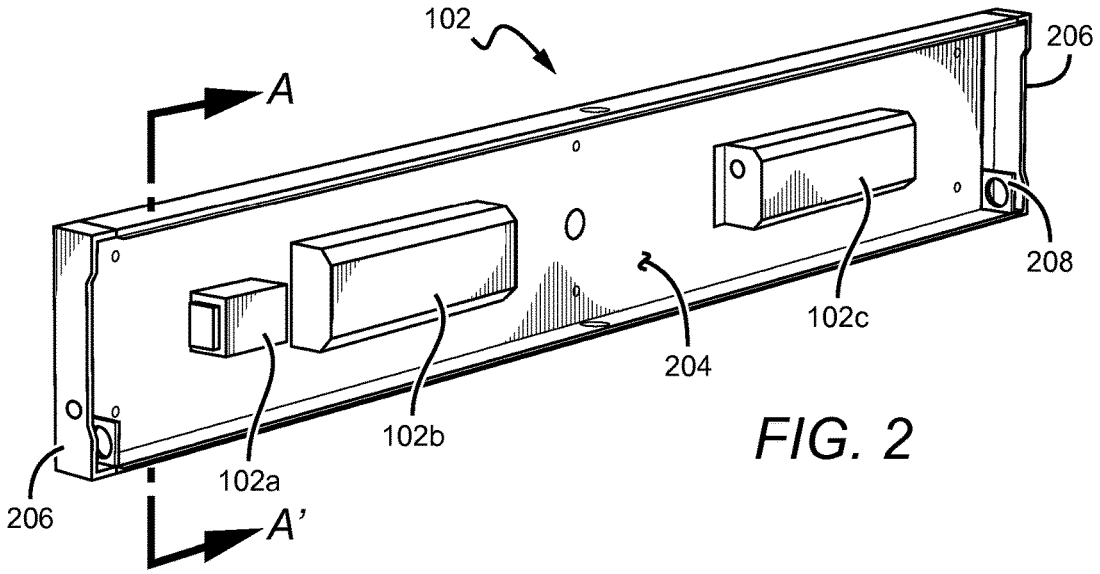
FIG. 2

FIG. 4a
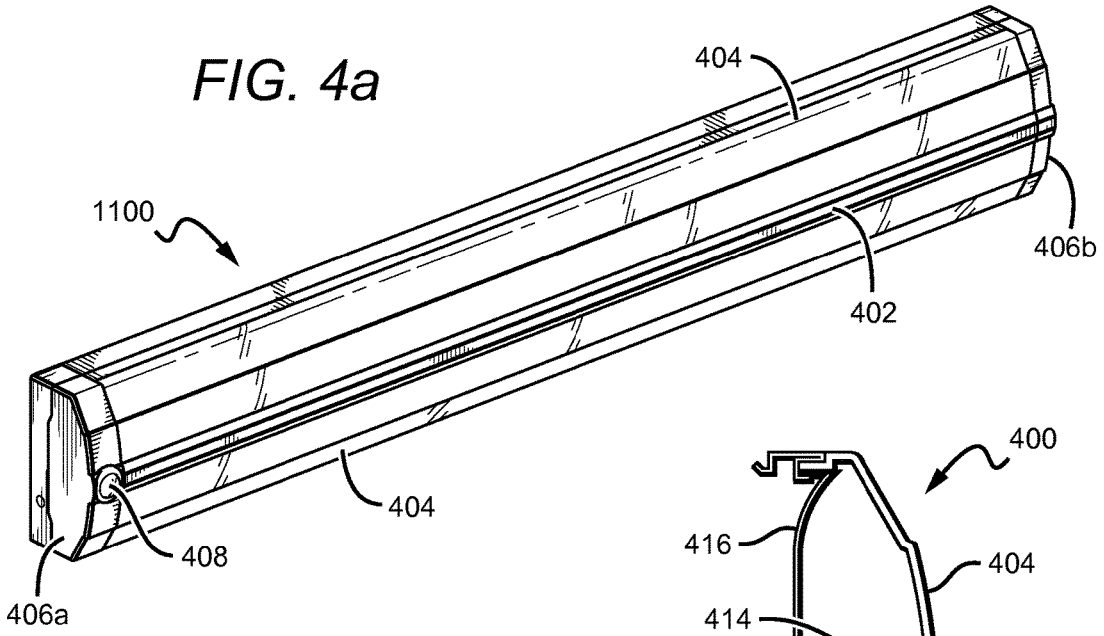
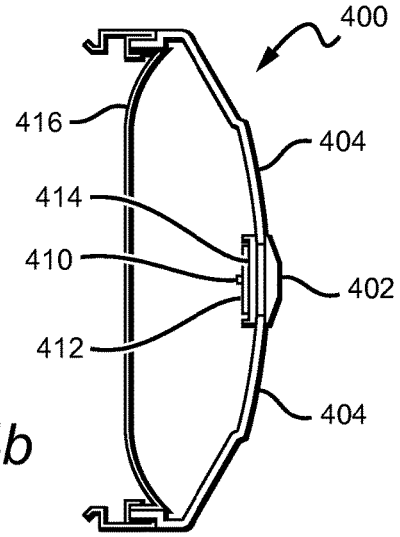
FIG. 4b
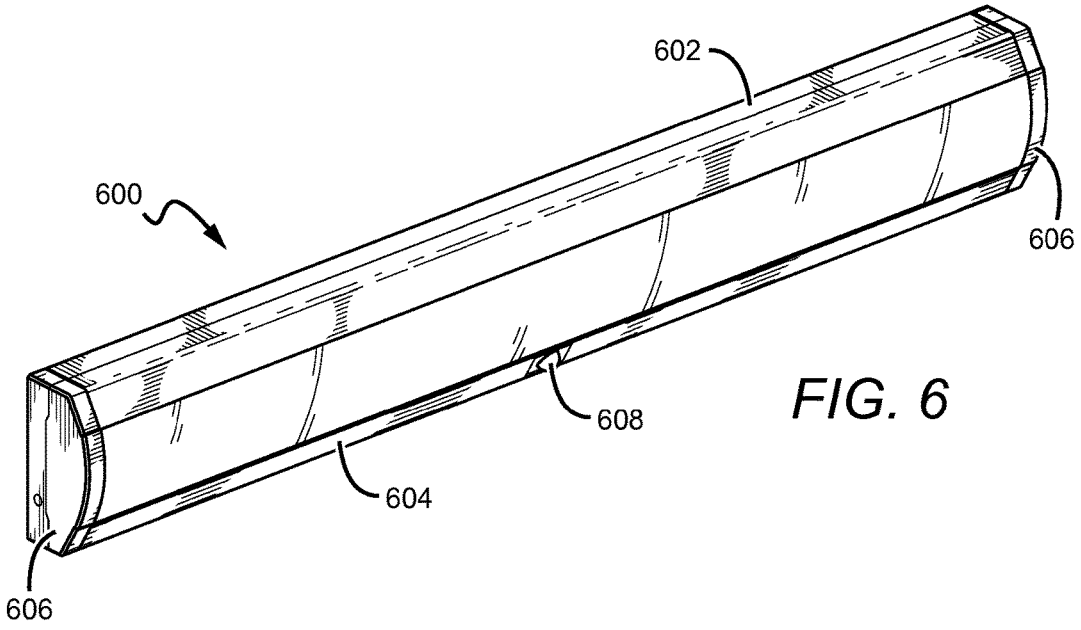
FIG. 6

FIG. 13a
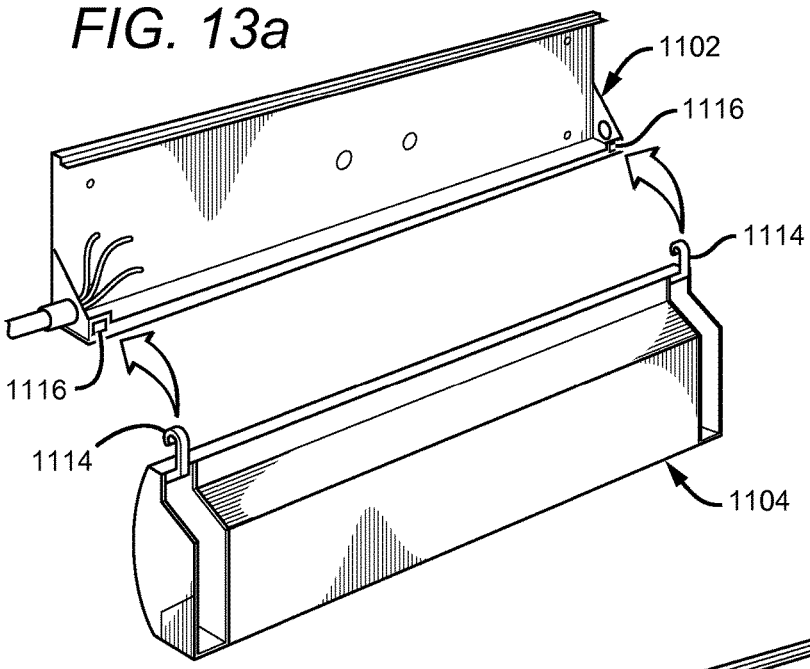
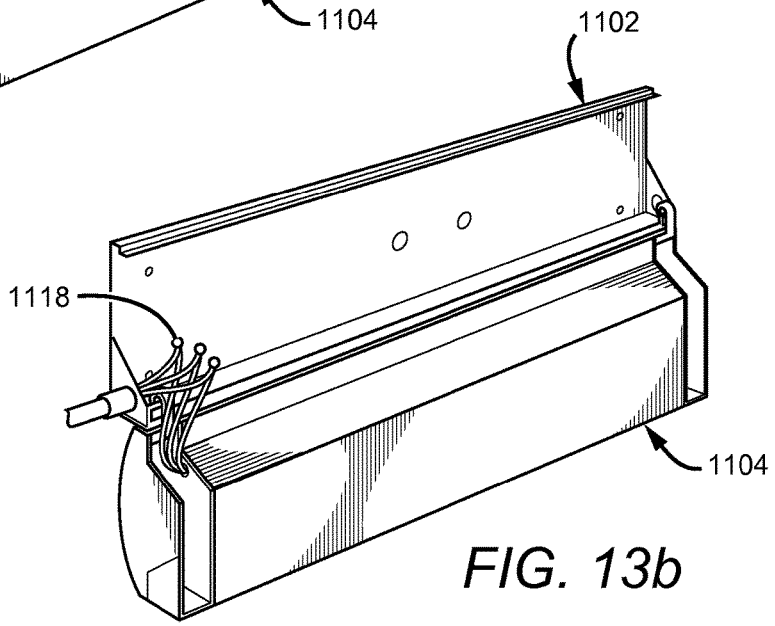
FIG. 13b
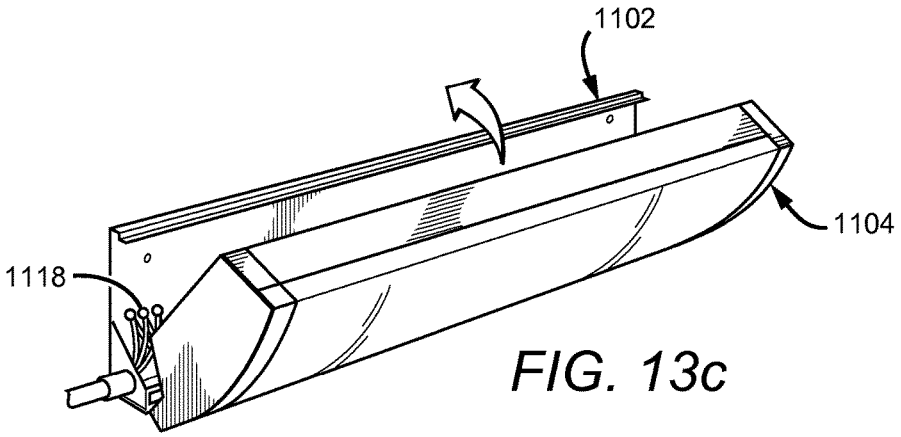
FIG. 13c

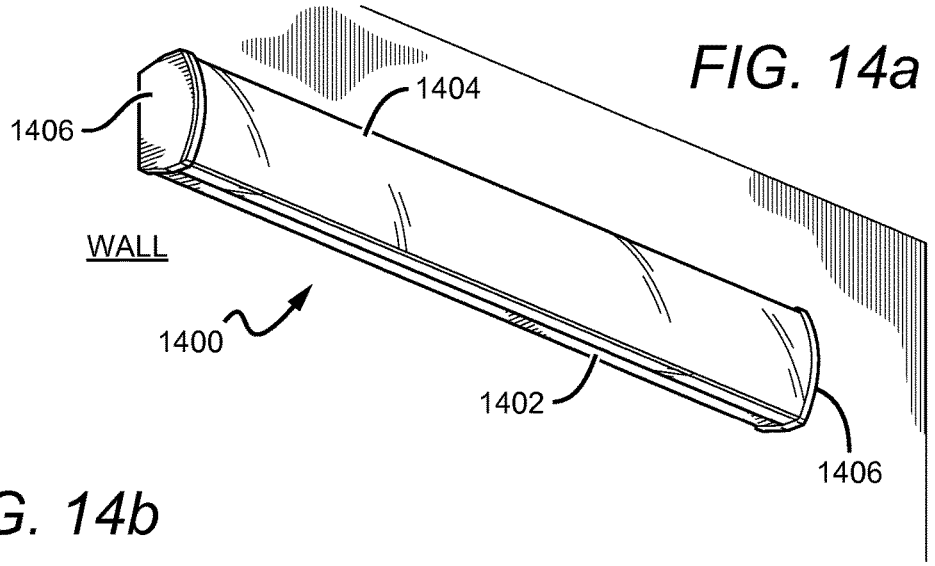
FIG. 14a
FIG. 14b
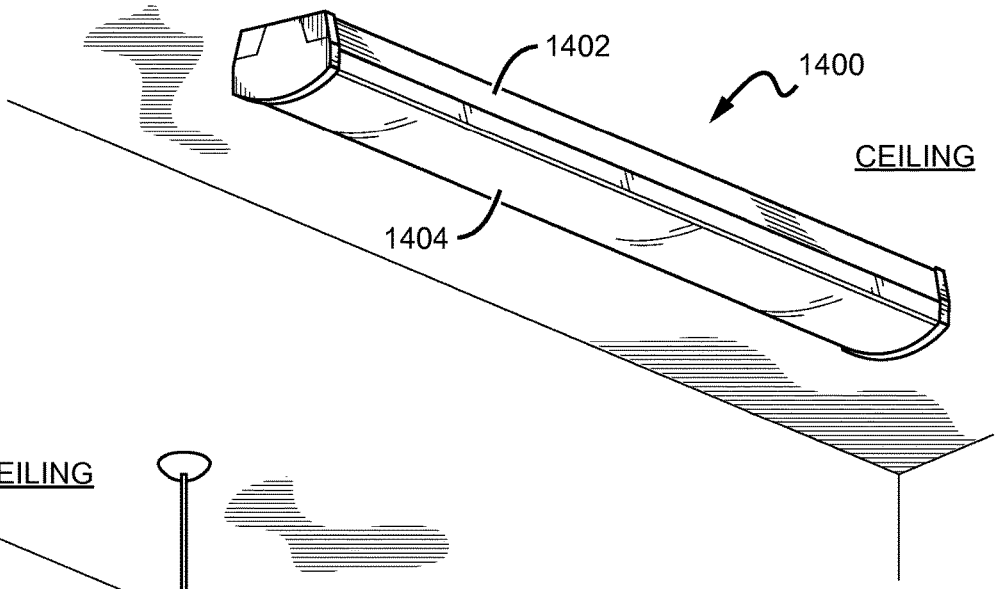
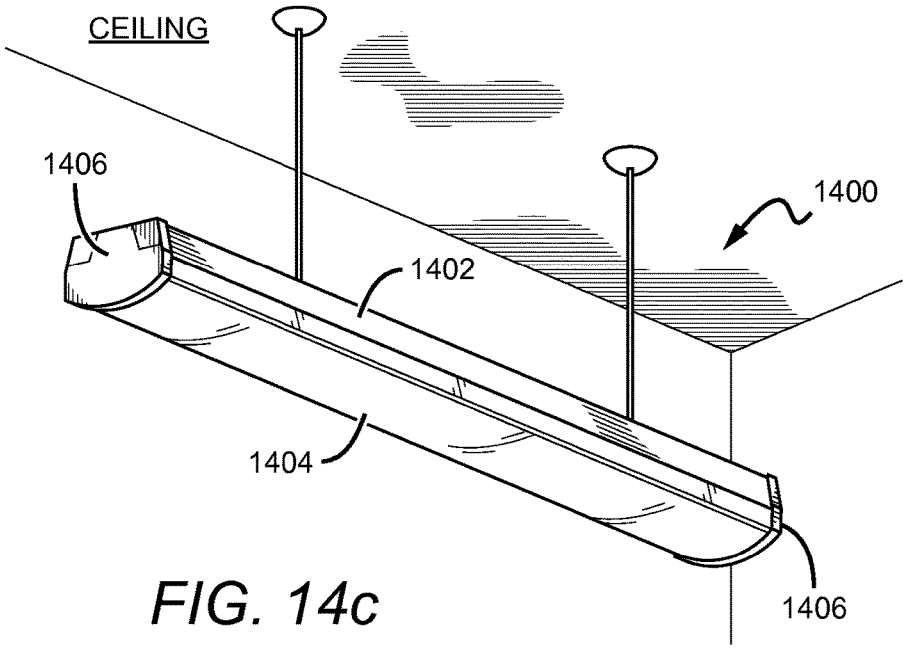
FIG. 14c

LINEAR LIGHT FIXTURE WITH INTERCHANGEABLE LIGHT ENGINE UNIT

BACKGROUND OF THE INVENTION

Field of the Invention

The invention relates to lighting fixtures and, more particularly, to modular lighting fixtures that are well-suited for use with solid state lighting sources, such as light emitting diodes (LEDs).

Description of the Related Art

Troffer-style fixtures (troffers) are ubiquitous in commercial office and industrial spaces throughout the world. In many instances these troffers house elongated fluorescent light bulbs that span the length of the troffer. Troffers may be mounted to or suspended from ceilings or walls. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that which often extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

An embodiment of a modular light fixture comprises the following elements. A housing subassembly is removably attached to a lighting subassembly. The lighting subassembly comprises at least one light source. Driver electronics are connected to control said at least one light source.

An embodiment of a modular light fixture comprises the following elements. A housing subassembly and a lighting subassembly are removably attached. The lighting subassembly comprises a body, a back reflector at least partially surrounded by the body, a heat sink with a mount surface mounted proximate to the back reflector, a plurality of light sources on the mount surface positioned such that at least a portion of the light emitted initially impinges on the back reflector, and a lens attached to the body, the lens configured to transmit at least a portion of light from the at least one light source. Driver electronics are connected to control the plurality of light sources.

An embodiment of a modular light fixture comprises the following elements. A housing subassembly is removably amounted to a lighting subassembly. The housing subassembly comprises an external mount mechanism. The lighting subassembly comprises at least one light source and driver electronics.

An embodiment of an extendable linear fixture comprises the following elements. A plurality of modular fixtures each comprises a lighting subassembly that is removably attached to a housing subassembly. The housing subassembly comprises an external mount mechanism. The lighting subassembly comprises at least one light source. At least one joiner structure is between adjacent of said modular fixtures, connecting said modular fixtures together.

BRIEF DESCRIPTION OF THE DRAWINGS

FIG. 1 is a perspective view of a modular light fixture according to an embodiment of the present invention.

FIG. 2 is a perspective view of a housing subassembly according to an embodiment of the present invention.

FIG. 3 is a cutaway side view of the housing subassembly 102 along cut line A-A'.

FIG. 4*a* is a perspective view of a lighting subassembly according to an embodiment of the present invention. FIG. 4*b* is a cross-sectional view thereof.

FIG. 6 is a perspective view of another lighting subassembly that may be used in embodiments of the present invention.

FIGS. 13*a-c* show perspective views of a modular light fixture according to an embodiment of the present invention during various stages of installation.

FIGS. 14*a-c* are perspective views of a modular light fixture according to an embodiment of the present invention.

DETAILED DESCRIPTION OF THE INVENTION

Figure 5A:
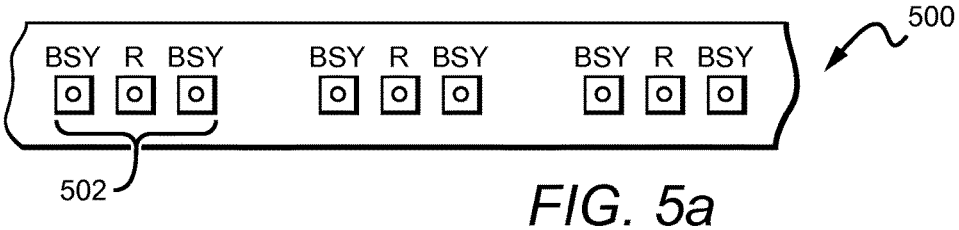
FIGS. 5*a-c* show a top plan view of portions of several light strips that may be used in embodiments of the present invention.

Embodiments of the present invention provide an indirect modular troffer-style fixture that is particularly well-suited for use with solid state light sources, such as LEDs, to provide a surface ambient light (SAL). The fixture comprises two structural components: a housing subassembly and a lighting subassembly. These two subassemblies may be removably attached to operate as a singular fixture. Many different lighting subassemblies may be compatible with a single housing subassembly and vice versa. The housing subassembly comprises a body that is mountable to an external structure. The lighting subassembly comprises the light sources and optical elements that tailor the outgoing light to achieve a particular profile. Both the shape and the arrangement of these elements provide the desired light output distribution. Electronics necessary to power and control the light sources may be disposed in either the housing subassembly or the lighting subassembly. Structural elements, such as end caps, may be used to hold the fixture elements and the subassemblies in position relative to each other. Various mount mechanisms may be used to attach the fixture to a surface such as a ceiling or a wall.

FIG. 1 is a perspective view of a modular light fixture 100 according to an embodiment of the present invention. The fixture 100 is particularly well-suited for use with solid state light emitters, such as LEDs or vertical cavity surface emitting lasers (VCSELs), for example. However, other kinds of light sources may also be used. The elongated fixture 100 comprises a housing subassembly 102 and a lighting subassembly 104. The two subassemblies 102, 104 are removably attached as shown. When assembled, the subassemblies 102, 104 define an internal cavity that houses several elements including the light sources and the driver electronics as shown in detail herein. The housing subassembly 102 is designed to work with many different lighting subassemblies such that they may be easily replaced to achieve a particular lighting effect, for example. Several examples of lighting subassemblies are discussed herein.

FIG. 2 is a perspective view of a housing subassembly 102 according to an embodiment of the present invention. In this embodiment, the housing subassembly 102 is designed to house driver electronics 202 which are mounted on an interior mount surface 204. The housing subassembly 102 comprises a first end cap portion 206 on both ends of the subassembly 102. At least one of the first end cap portions 206 has a receiving structure 208 designed to mate with a second end cap portion (not shown) on the lighting subassembly 104 as shown in more detail herein.

In this embodiment, the driver electronic component boxes comprise a backup battery box 202*a, a* driver box 202*b*, and a step-down converter box 202*c*. The step-down converter box 202*c* is an optional element that may be included in models requiring a non-standard voltage, for example, models for use in Canada or another country. Many different mount arrangements are possible to accommodate the necessary electronic components within the housing subassembly 102, and many different combinations of electronic components may be used.

FIG. 3 is a cutaway side view of the housing subassembly 102 along cut line A-A'. The electronic components 102*a*, 102*b*, 102*c* are mounted on the interior mount surface 204 along the longitudinal axis of the housing subassembly 102. Tabs 302 are used to aid in connecting the housing subassembly 102 with the lighting subassembly 104. The housing subassembly 102 is configured to receive many different lighting subassemblies to provide a fixture having a desired optical effect. Thus, the housing subassembly 102 functions as a universal receiving structure for various embodiments of lighting subassemblies as discussed in more detail herein.

In one embodiment the electronic components comprise a step-down converter 102*a*, a driver circuit 102*b*, and a battery backup 102*c*. At the most basic level a driver circuit may comprise an AC/DC converter, a DC/DC converter, or both. In one embodiment, the driver circuit comprises an AC/DC converter and a DC/DC converter both of which are located in the housing subassembly 102. In another embodiment, the AC/DC conversion is done in the housing subassembly 102, and the DC/DC conversion is done in the lighting subassembly 104. Another embodiment uses the opposite configuration where the DC/DC conversion is done in the housing subassembly 102, and the AC/DC conversion is done in the lighting subassembly 104. In yet another embodiment, both the AC/DC converter and the DC/DC converter are located in the lighting subassembly 104. It is understood that the various electronic components may distributed in different ways in one or both of the subassemblies 102, 104.

FIG. 4*a* is a perspective view of an embodiment of a lighting subassembly 400. FIG. 4*b* is a cross-sectional view of the lighting subassembly 400. This particular embodiment comprises an elongated heat sink 402 and a pair of lenses 404 that run longitudinally between first and second end caps 406*a*, 406*b* which function to hold the heat sink 402 and the lenses 404 together. The lighting subassembly 400 includes an optional sensor 408 which is housed in the end cap 406*a*.

Information from the sensor 408 is used to control the on/off state of the internal light sources to conserve energy when lighting in a particular area is not needed. The sensor may also be used to regulate the brightness of the sources, allowing for high and low modes of operation. In one embodiment, a passive infrared (PIR) sensor 408 is used to determine when a person is in the vicinity of the fixture and thus would require light in the area. When the sensor detects a person, a signal is sent to the driver circuit and the lights are turned on, or if the lights remain on at all times, then the lights are switched to the high mode of operation. When the heat signature is no longer present, then the sources switch back to the default state (e.g., off or low mode). Many other types of sensors may be used such as a motion detector or an ultrasonic sensor, for example.

FIG. 4*b* is a cross-sectional view of the lighting subassembly 400. In this embodiment, at least one LED 410 on a light strip 412 is mounted on an internal surface 414 of the heat sink 402. The LEDs 410 can also be mounted to other internal surfaces inside the optical chamber. When powered, the LEDs 410 emit light in a direction such that it is incident on a back reflector 416. The back reflector 416 then redirects at least a portion of the light out of the optical chamber through the lenses 404.

In this embodiment, the back side of the heat sink 402, which comprises internal surface 414, functions as an internal surface of the lighting subassembly 400. The heat sink 402 can be constructed using many different thermally conductive materials. For example, the heat sink 402 may comprise an aluminum body. Similarly as the back reflector 416, the heat sink 402 can be extruded for efficient, cost-effective production and convenient scalability. In other embodiments, the heat sink 402 can be integrated with a printed circuit board (PCB), for example. Indeed the PCB itself may function as the heat sink, so long as the PCB is capable of handling thermal transmission of the heat load. Many other heat sink structures are possible.

Figure 5B:
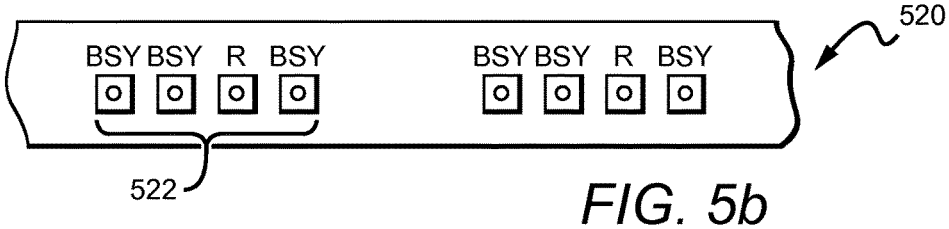
Figure 5C:
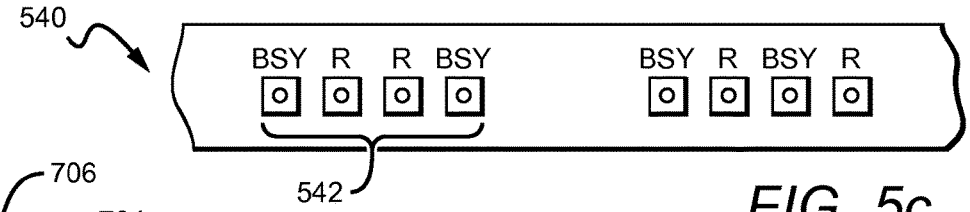

The heat sink 402 can be mounted to the lighting subassembly 400 using various methods such as, screws, pins, or adhesive, for example. In this particular embodiment, the heat sink 402 comprises an elongated thin body with a substantially flat area internal surface 414 on which one or more light sources can be mounted. The flat area provides for good thermal communication between the heat sink 402 and the light sources 410 mounted thereon. In some embodiments, the light sources will be pre-mounted on light strips. FIGS. 5*a-c* show a top plan view of portions of several light strips 500, 520, 540 that may be used to mount multiple LEDs to the heat sink 118, and in some embodiments a sink may be integrated with the light strips 500, 520, 540. As previously mentioned, although LEDs are used as the light sources in various embodiments described herein, it is understood that other light sources, such as laser diodes for example, may be substituted in as the light sources in other embodiments.

Many industrial, commercial, and residential applications call for white light sources. Embodiments of lighting subassemblies may comprise one or more emitters producing the same color of light or different colors of light. In one embodiment, a multicolor source is used to produce white light. Several colored light combinations will yield white light. For example, it is known in the art to combine light from a blue LED with wavelength-converted yellow (blue-shifted-yellow or "BSY") light to yield white light with correlated color temperature (CCT) in the range from 5000K to 7000K (often designated as "cool white"). Both blue and BSY light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

The lighting strips 500, 520, 540 each represent possible LED combinations that result in an output spectrum that can be mixed to generate white light. Each lighting strip can include the electronics and interconnections necessary to power the LEDs. In some embodiments the lighting strip comprises a printed circuit board with the LEDs mounted and interconnected thereon. The lighting strip 500 includes clusters 502 of discrete LEDs, with each LED within the cluster 502 spaced a distance from the next LED, and each cluster 502 spaced a distance from the next cluster 502. If the LEDs within a cluster are spaced at too great distance from one another, the colors of the individual sources may become visible, causing unwanted color-striping. The clusters on the light strips can be compact. In some embodiments, an acceptable range of distances for separating consecutive LEDs within a cluster is not more than approximately 8 mm.

The scheme shown in FIG. 5*a* uses a series of clusters 502 having two blue-shifted-yellow LEDs ("BSY") and a single red LED ("R"). Once properly mixed the resultant output light will have a "warm white" appearance.

The lighting strip 520 includes clusters 522 of discrete LEDs. The scheme shown in FIG. 5*b* uses a series of clusters 522 having three BSY LEDs and a single red LED. This scheme will also yield a warm white output when sufficiently mixed.

The lighting strip 540 includes clusters 542 of discrete LEDs. The scheme shown in FIG. 5*c* uses a series of clusters 542 having two BSY LEDs and two red LEDs. This scheme will also yield a warm white output when sufficiently mixed.

The lighting schemes shown in FIGS. 5*a-c* are meant to be exemplary. Thus, it is understood that many different LED combinations can be used in concert with known conversion techniques to generate a desired output light color.

Again with reference to FIG. 4*b*, the back reflector 416 can be constructed from many different materials. In one embodiment, the back reflector 416 comprises a material which allows it to be extruded for efficient, cost-effective production. Some acceptable materials include polycarbonates, such as Makrolon 6265X or FR6901 (commercially available from Bayer) or BFL4000 or BFL2000 (commercially available from Sabic). Many other materials may also be used to construct the back reflector 416. Using an extrusion process for fabrication, the back reflector 416 is easily scalable to accommodate lighting assemblies of varying length.

The back reflector 416 is an example of one shape that may be used in the lighting subassembly 400. The back reflector 416 may be designed to have several different shapes to perform particular optical functions, such as color mixing and beam shaping, for example. The back reflector 416 may be rigid, or it may be flexible in which case it may be held to a particular shape by compression against other surfaces. Emitted light may be bounced off of one or more surfaces. This has the effect of disassociating the emitted light from its initial emission angle. Output color uniformity typically improves with an increasing number of bounces, but each bounce has an associated optical loss. In some embodiments an intermediate diffusion mechanism (e.g., formed diffusers and textured lenses) may be used to mix the various colors of light.

The back reflector 416 should be highly reflective in the wavelength ranges emitted by the source(s) 122. In some embodiments, the reflector may be 93% reflective or higher. In other embodiments it may be at least 95% reflective or at least 97% reflective.

The back reflector 416 may comprise many different materials. For many indoor lighting applications, it is desirable to present a uniform, soft light source without unpleasant glare, color striping, or hot spots. Thus, the back reflector 416 may comprise a diffuse white reflector such as a microcellular polyethylene terephthalate (MCPET) material or a Dupont/WhiteOptics material, for example. Other white diffuse reflective materials can also be used.

Diffuse reflective coatings may be used on a surface of the back reflector to mix light from solid state light sources having different spectra (i.e., different colors). These coatings are particularly well-suited for multi-source designs where two different spectra are mixed to produce a desired output color point. For example, LEDs emitting blue light may be used in combination with other sources of light, e.g., yellow light to yield a white light output. A diffuse reflective coating may eliminate the need for additional spatial color-mixing schemes that can introduce lossy elements into the system; although, in some embodiments it may be desirable to use a diffuse surface in combination with other diffusive elements. In some embodiments, the surface may be coated with a phosphor material that converts the wavelength of at least some of the light from the light emitting diodes to achieve a light output of the desired color point.

By using a diffuse white reflective material for the back reflector 416 and by positioning the light sources to emit light first toward the back reflector 416 several design goals are achieved. For example, the back reflector 416 performs a color-mixing function, effectively doubling the mixing distance and greatly increasing the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers to ameliorate in a traditional direct view optic can be managed with much less aggressive (and lower light loss) diffusers achieving max/min ratios of 5:1, 3:1, or even 2:1.

The back reflector 416 can comprise materials other than diffuse reflectors. In other embodiments, the back reflector 416 can comprise a specular reflective material or a material that is partially diffuse reflective and partially specular reflective. In some embodiments, it may be desirable to use a specular material in one area and a diffuse material in another area. For example, a semi-specular material may be used on the center region with a diffuse material used in the side regions to give a more directional reflection to the sides. Many combinations are possible.

In this embodiment, a small percentage, if any, of the light emitted from the sources 410 is directly incident on the lenses 404. Instead, most of the light is first redirected off of the back reflector 416. This first bounce off the back reflector 416 mixes the light and reduces imaging of any of the discrete light sources 410. However, additional mixing or other kinds of optical treatment may still be necessary to achieve the desired output profile. Thus, the lenses 404 may be designed to perform these functions as the light passes through it. The lenses 404 can comprise many different elements and materials.

In one embodiment, the lenses 404 comprise a diffusive element. A diffusive exit lens functions in several ways. For example, it can prevent direct visibility of the sources and provide additional mixing of the outgoing light to achieve a visually pleasing uniform source. However, a diffusive exit lens can introduce additional optical loss into the system. Thus, in embodiments where the light is sufficiently mixed by the back reflector 416 or by other elements, a diffusive exit lens may be unnecessary. In such embodiments, a transparent glass exit lens may be used, or the exit lens may be removed entirely. In still other embodiments, scattering particles may be included in the exit lens 104. Some embodiments may include a specular or partially specular back reflector. In such embodiments, it may be desirable to use a diffuse exit lens.

Diffusive elements in the lenses 404 can be achieved with several different structures. A diffusive film inlay can be applied to the top- or bottom-side surface of the lenses 404. It is also possible to manufacture the lenses 404 to include an integral diffusive layer, such as by coextruding the two materials or by insert molding the diffuser onto the exterior or interior surface. A clear lens may include a diffractive or repeated geometric pattern rolled into an extrusion or molded into the surface at the time of manufacture. In another embodiment, the exit lens material itself may comprise a volumetric diffuser, such as an added colorant or particles having a different index of refraction, for example.

In other embodiments, the lenses 404 may be used to optically shape the outgoing beam with the use of microlens structures, for example. Microlens structures are discussed in detail in U.S. patent application Ser. No. 13/442,311 to Lu, et al., which is commonly assigned with the present application to CREE, INC. and incorporated by reference herein.

FIG. 6 is a perspective view of another lighting subassembly 600 that may be used in conjunction with the housing subassembly 102. It is understood that the lighting subassembly 102 is simply another exemplary embodiment of a lighting subassembly, and that many different lighting subassemblies may be used to provide a particular lighting effect. The lighting subassembly 600 is particularly well-suited for use with solid state light emitters, such as LEDs or vertical cavity surface emitting lasers (VCSELs), for example. However, other kinds of light sources may also be used. An elongated body 602 provides the primary mechanical structure for the lighting subassembly 600. An exit lens 104 provides a transmissive window through which light is emitted. End caps 106 cover the ends of the housing 102 and hold the housing 102 and the exit lens 104 in place. The housing 102, exit lens 104, and end caps 106 define an internal cavity that houses several elements including the light sources and the driver electronics as shown in detail herein. In this embodiment a sensor 108 protrudes through the body 102. Information from the sensor 108 is used to control the internal light sources. The lighting subassembly 600 can be attached to a housing assembly such as the housing assembly 102. The two subassemblies 102, 600 may be attached using a snap-fit structure, screws, or the like. In some instances a more permanent attachment mechanism may be used such as adhesive, for example.

Figure 7:
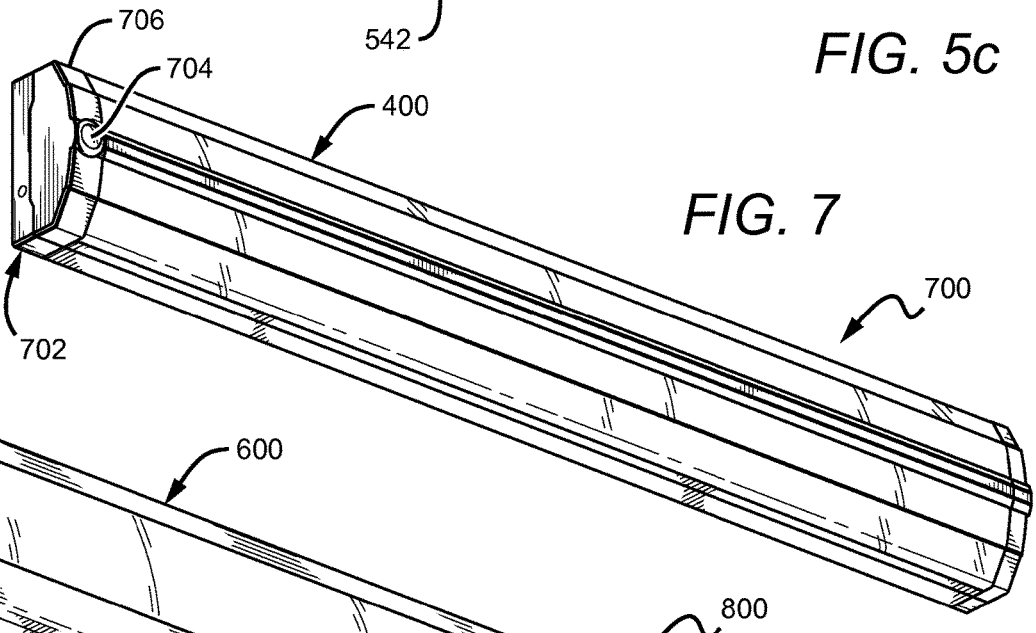
FIG. 7 is a perspective view of a modular light fixture according to an embodiment of the present invention.

FIG. 7 is a perspective view of an embodiment of a modular light fixture 700. The fixture comprises a housing subassembly 702 removably attached to the lighting subassembly 400 shown in FIG. 4. The fixture 700 is similar to the fixture 100 shown in FIG. 1; however, the fixture 700 comprises a sensor 704. The sensor 704 provides information to the driver circuit that is used to control the light sources. In this embodiment, the sensor 704 is integral with a first end cap 706. Many different kinds of sensors can be used depending on the operating environment and the nature of the objects to be sensed. In other embodiments, a sensor can be located in several different alternate positions such as along the heat sink, for example.

Figure 8:
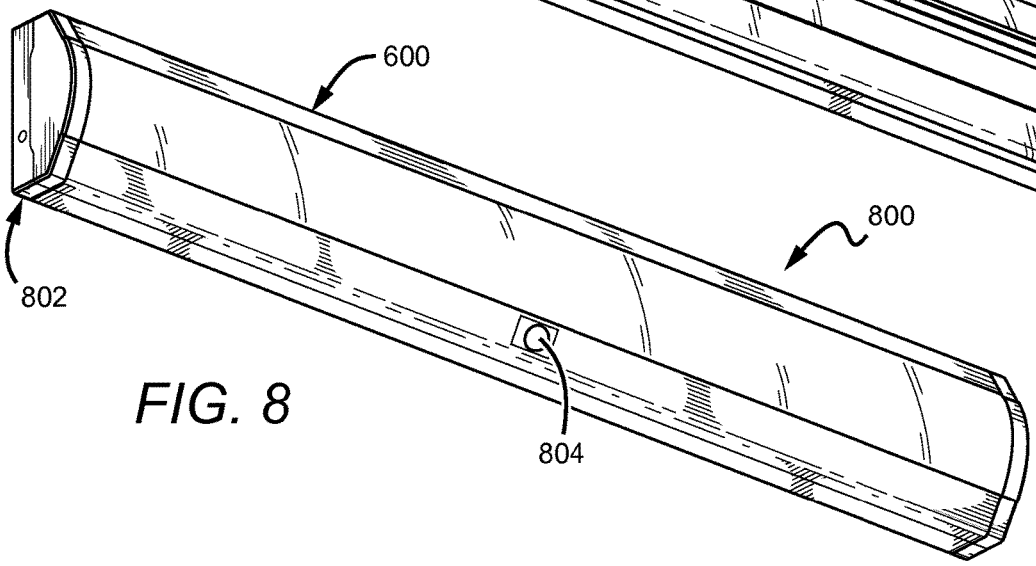
FIG. 8 is a perspective view of a modular light fixture according to an embodiment of the present invention.

FIG. 8 is a perspective view of an embodiment of a modular light fixture 800. The fixture comprises a housing subassembly 802 that is removably attached to the lighting subassembly 600 shown in FIG. 6. This embodiment also comprises the sensor 608 which is integral with the body 602 of the lighting subassembly 600.

Figure 9:
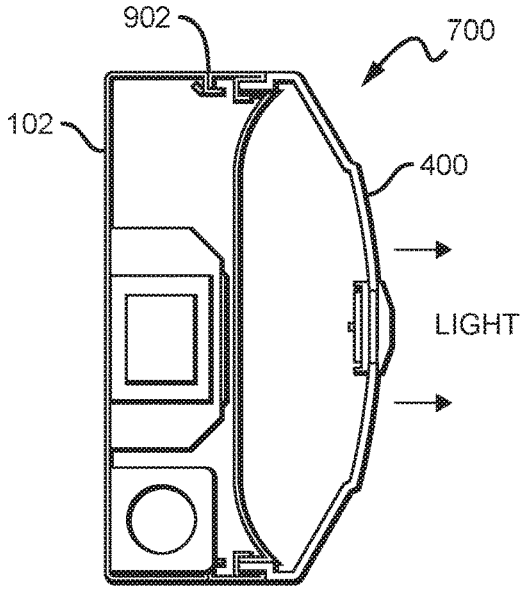
FIG. 9 is a cut-away side view of a modular fixture according to an embodiment of the present invention.

FIG. 9 is a cut-away side view of the modular light fixture 700. The housing subassembly 102 is removably attached to the lighting subassembly 400 with a snap-fit mechanism 902, although other attachment means are possible. The fixture 700 is designed to provide a symmetrical light output wherein the primary direction of the light emission is straight out from the fixture 700 as shown.

Figure 10:
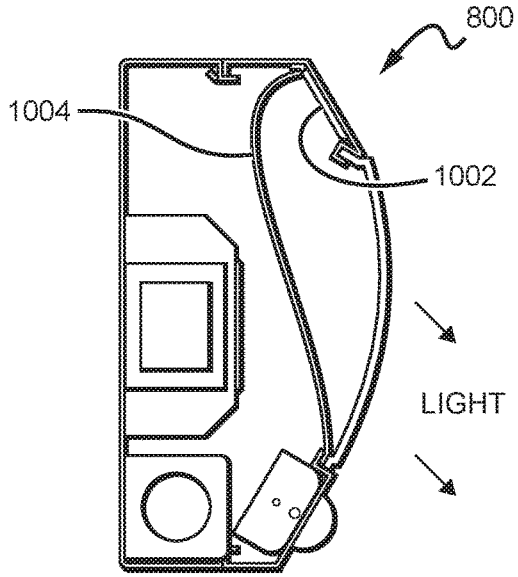
FIG. 10 is a cut-away side view of a modular light fixture according to an embodiment of the present invention.

FIG. 10 is a cut-away side view of the modular light fixture 800. The housing subassembly 102 is removably attached to the lighting subassembly 600 with a snap-fit mechanism 1000, although other attachment means are possible. Dissimilarly from the fixture 700, the fixture 800 is designed to provide an asymmetrical light output distribution. In this particular embodiment, the back reflector 1004 has a curved shape approximated by a spline curve. The shape has an asymmetric transverse cross-section. The back reflector 1004 extends farther in the transverse direction on one side of the light sources 1002 than on the other side. The light sources 1002 are disposed off-center relative to a central longitudinal axis running through the center of the housing 102. Additionally, the light sources 1002 are emit at an angle that is off-center with respect to the back reflector 124; i.e., light emitted from the sources is incident on off-center areas of the back reflector 1004 more heavily. The positioning of the light sources 1002 and the asymmetric shape and placement of the back reflector 1004 result in an asymmetric light distribution. Such an output is useful for lighting areas where more light is required in a given direction, such as stairwell, for example. In a stairwell it is important to light stairs that descend and/or ascend from a given level; thus, an asymmetric output distribution may be used to direct more of the light into these specific areas, reducing the total amount of light that is necessary to light such as an area.

There are many different light subassembly configurations that can be used to provide an asymmetrical light output distribution. Several such configurations are discussed in U.S. patent application Ser. No. 13/830,698 titled "LINEAR SOLID STATE LIGHTING FIXTURE WITH ASYMMETRIC DISTRIBUTION" to Durkee et al., filed on Mar. 14, 2013, which is commonly owned with the present application by Cree, Inc. and incorporated by reference herein.

Figure 11:
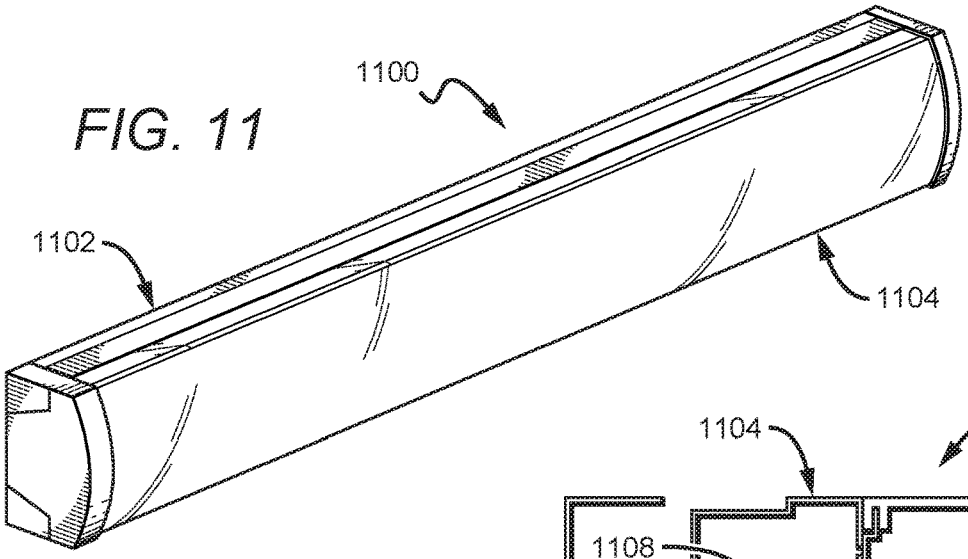
FIG. 11 is a perspective view of a modular light fixture according to an embodiment of the present invention.

FIG. 11 is a perspective view of an embodiment of modular light fixture 1100. This particular embodiment comprises housing subassembly 1102 and a lighting subassembly 1104 that are removably attached.

Figure 12:
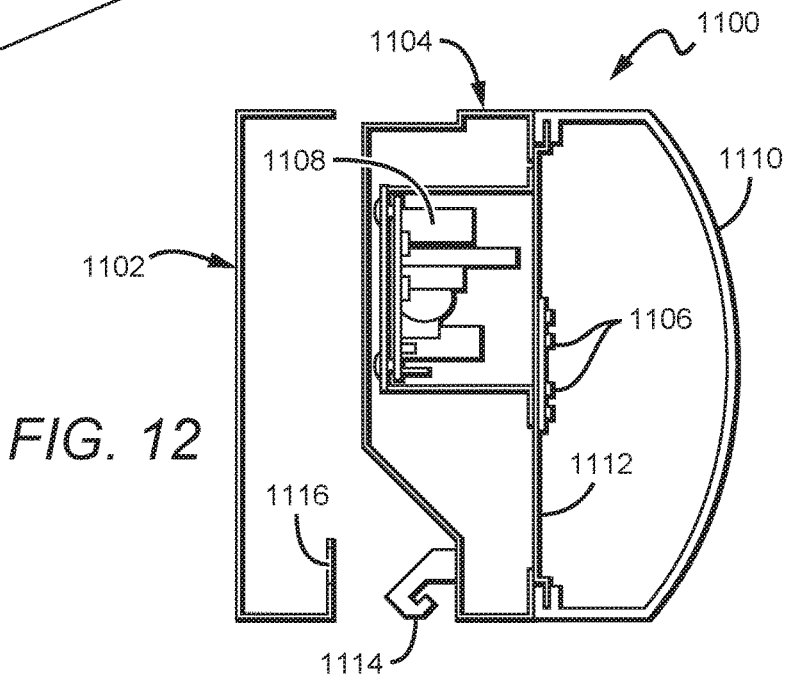
FIG. 12 is a cross-sectional view of a modular light fixture according to an embodiment of the present invention.

FIG. 12 is a cross-sectional view of the fixture 1100. The housing subassembly 1102 and the lighting subassembly 1104 are shown detached. In this embodiment, light sources 1106 and driver electronics 1108 are both housed within the lighting subassembly. Furthermore, the light sources 1106 are positioned to emit light such that it directly impinges on an exit lens 1110 and passes out of the optical chamber and into the ambient. Thus, the fixture 1100 is a direct lighting fixture as opposed to the indirect fixtures 600, 800 where the light first impinges on a back reflector and is redirected with at least one internal bounce before passing through an exit lens. Here, a back reflector 1112 is behind the initial direction of emission from the sources 1106, redirecting any light that may have not have exited the chamber on the first pass because, for example, of total internal reflection at the lens 1110.

The two subassemblies 1102, 1104 are attached with a hook-and-eye mechanism with the lighting subassembly 1104 comprising a hook 1114 and the housing subassembly comprising the receiving eye 1116. In another embodiment, the hook can be a component of the housing subassembly, and the eye a component of the lighting subassembly.

FIGS. 13*a-c* show perspective views of the fixture 1100 during various stages of installation. In FIG. 13*a* the lighting subassembly 1104 is temporarily suspended from the housing subassembly 1102 by inserting the hooks 1114 into the receiving eyes 1116 such that the internal surfaces of both subassemblies 1102, 1104 are facing away from the mount surface, toward the installer. In FIG. 13*b* the wiring connections 1118 are made joining the wires bringing power from an outside source to the wires connected to the light sources in the lighting subassembly 1104. In FIG. 13*c* the lighting subassembly 1104 is swiveled up about the hooks 1114 and fastened to the housing subassembly 1102, using for example, a snap-fit structure. The wiring connections 1118 are then enclosed within the fixture. It is understood that the method and structures shown in FIGS. 13*a-c* are merely exemplary and that many different mechanisms can be used to attach the two subassemblies 1102, 1104 during installation.

FIGS. 14*a-c* are perspective views of an embodiment of a modular lighting fixture 1400. The fixture 1400 comprises a housing subassembly 1402 and a lighting subassembly 1404 that are removably attached. In this particular embodiment, the end caps 1406 are separate components rather than an integral part of either subassembly. The fixture 1400 can be mounted to a wall (FIG. 14*a*), mounted to a ceiling (FIG. 14*b*), mounted to another surface, or it can be suspended from the ceiling in a pendant configuration (FIG. 14*c*).

Figure 15:
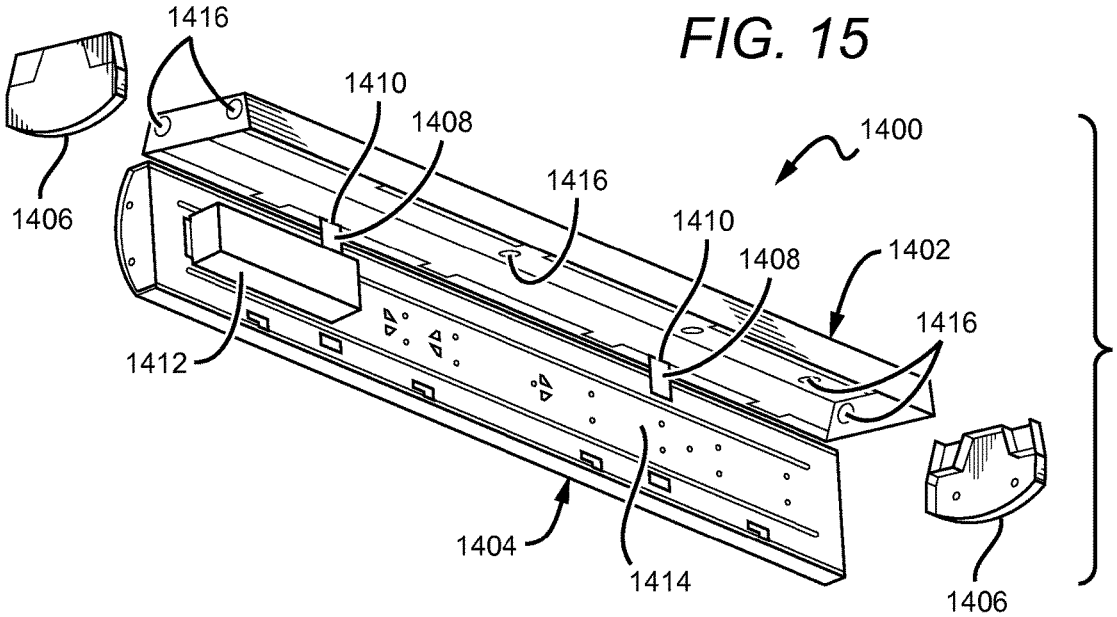
FIG. 15 is an exploded view of a modular light fixture according to an embodiment of the present invention that is mounted to a ceiling.

FIG. 15 is an exploded view of the modular lighting fixture 1400 that is mounted to a ceiling. In this embodiment, the lighting subassembly includes a set of tether clips 1408 that correspond to a set of flanges 1410 on the housing subassembly 1402. During installation the tether clips 1408 are hooked over the flanges 1410 such that the lighting subassembly 1404 may be suspended temporarily from the housing subassembly 1402 which is mounted firmly to the ceiling surface. Once any wiring connections are made, the lighting subassembly 1404 can be swung up to connect to the housing subassembly 1402 with a hook-and-slot mechanism as shown. To complete the attachment, the lighting assembly 1404 hook is aligned with the slot and then slides laterally to engage the housing subassembly 1402. Other mechanisms can be used to attach the subassemblies 1402, 1404 such as a snap-fit structure or the like. Then the end caps 1406 are placed over the ends of both subassemblies 1402, 1404. Then the end caps 1406 may be fastened to the subassemblies 1402, 1404 using a similar snap-fit mechanism, screws, or other structures. The end caps 1406 may also serve to hold the subassemblies firmly together and complete the electronic enclosure.

The driver electronics 1412 are mounted to an interior surface 1414 of the lighting subassembly 1404. The interior surface 1414 can accommodate other electronic components as necessary. When the subassemblies 1402, 1404 are attached, the components on the interior surface 1414 of the lighting assembly 1404 fold into the space hollow space within the housing assembly 1402. Several knockouts 1416 are disposed along the housing subassembly 1402. The knockouts 1416 can be removed to feed wiring into the housing subassembly 1402 for connection with the driver electronics 1412.

Figure 16:
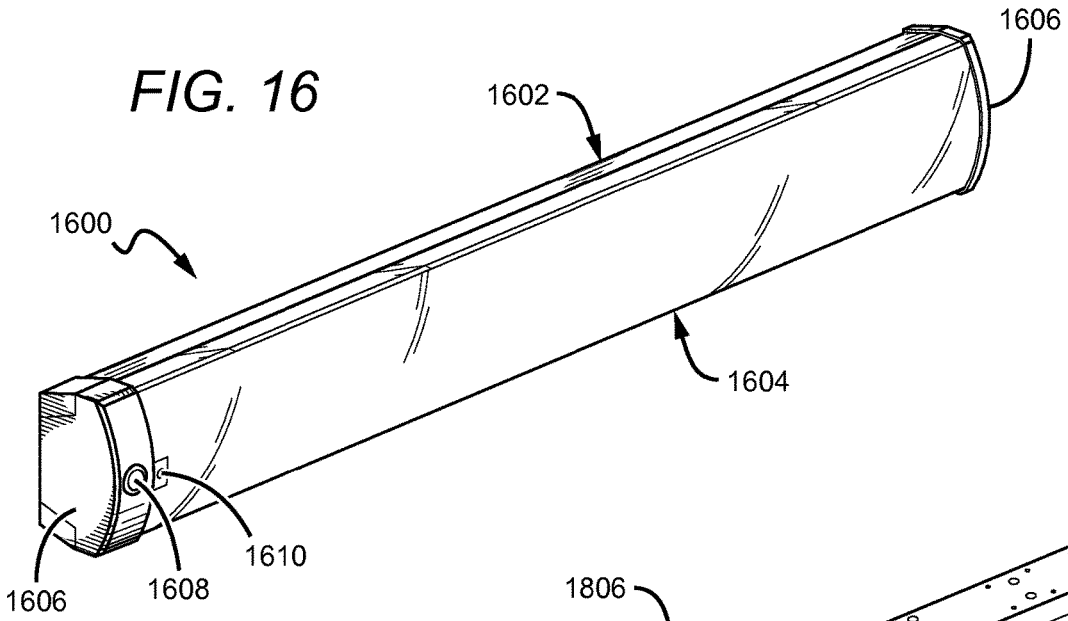
FIG. 16 is a perspective view of a modular light fixture according to an embodiment of the present invention.

FIG. 16 is a perspective view of an embodiment of a modular light fixture 1600. The fixture 1600 is similar to the fixture 1400 also comprising a housing subassembly 1602 that is removably attached to a lighting subassembly 1604. However, the fixture 1600 includes end caps 1606 wherein one of the end caps 1606 has a built-in sensor 1608 to provide information to the drive electronics to control the light sources. A test/reset button 1610 is also included to facilitate maintenance by providing a convenient way to check the operation of the sensor 1608, the light sources, or another electronic component without having to detach the subassemblies 1602, 1604.

Figure 17:
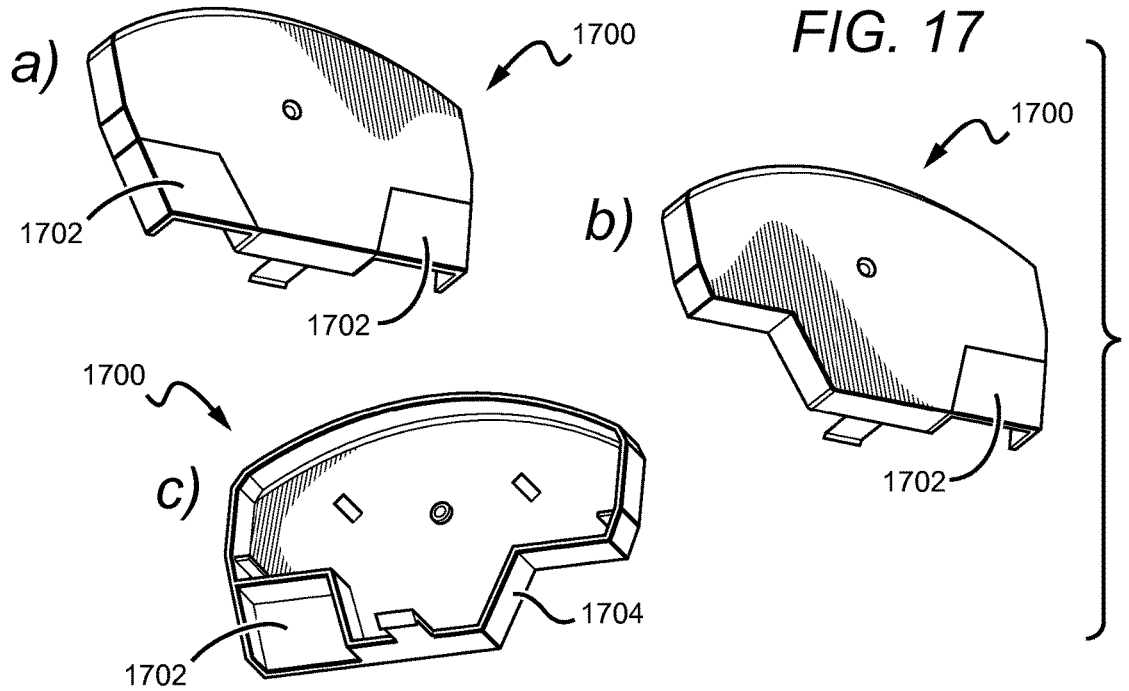
FIGS. 17*a-c* show perspective views of an end cap that may be used in embodiments of present invention.

FIGS. 17*a-c* show perspective views of an end cap 1700 that may be used in embodiments of present invention. The end cap 1700 attaches to the ends of fixtures similar to the fixture 1400. The end cap 1700 comprises knockout portions 1702 that may be removed to provide a pathway for wires running into the fixture housing. FIG. 17*b* shows the end cap 1702 after one of the knockouts has been removed. FIG. 17*c* shows the back side of the end cap 1702 which features a ridge 1704 that outlines a part of the footprint of the knockout 1702. The ridge 1704 provides a smooth reinforced surface for the space that exists after the knockout 1702 is removed. Thus, wiring that runs through into the fixture through the space left by the knockout can freely slide back and forth with minimal fraying and wear, bringing the end cap 1700 into conformity with international standards regarding structures for supporting electrical wiring.

Figure 18C:
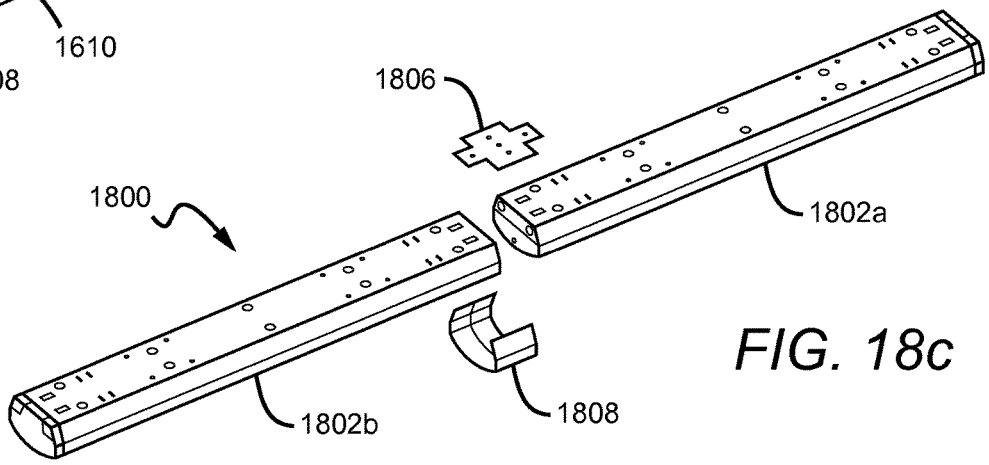
FIGS. 18*a-c* shows an embodiment of an extended modular fixture according to an embodiment of the present invention.
Figure 18A:
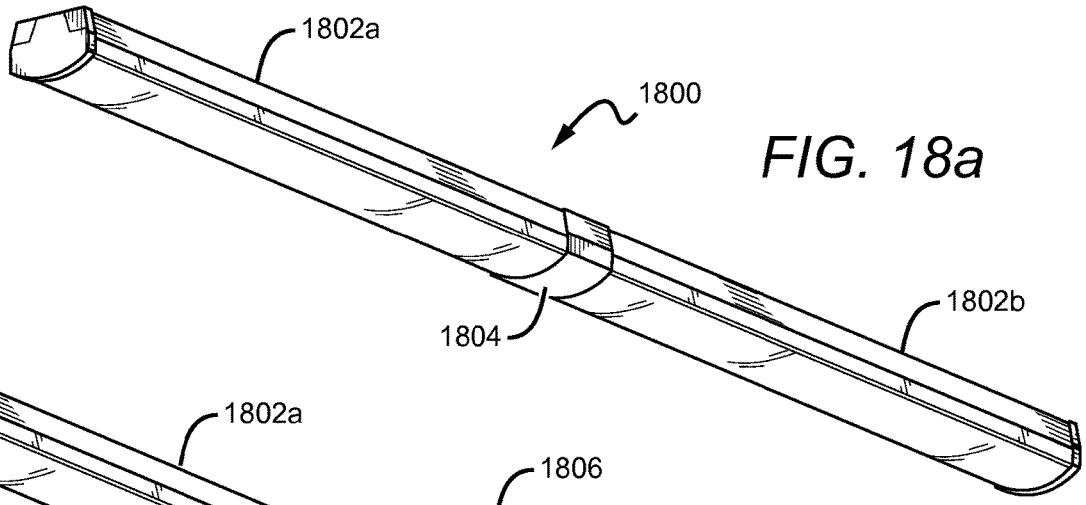
Figure 18B:
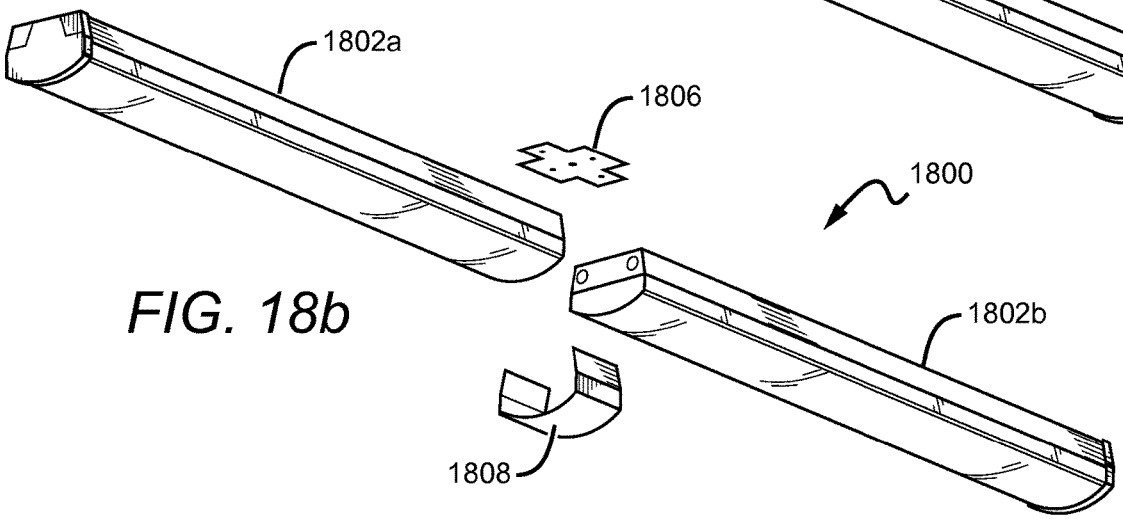

FIGS. 18*a-c* shows an embodiment of an extended modular fixture 1800. FIG. 18*a* shows two smaller linear fixtures 1802*a*, 1802*b*, which are similar to the fixture 1400 in many respects, that have been attached together to form the extended fixture 1800. The intermediate joiner plate 1804 provides the attachment mechanism. The individual fixtures 1802*a*, 1802*b* can be separately connected to a power sources or then can be serially connected with wires passing through the joiner structure 1804 to complete the electrical connection. In this way, additional fixtures may be added to the ends to extend the fixture 1800 in either direction, for example, to light a continuous corridor. FIGS. 18*b* and 18*c* show the fixture 1800 before the small fixtures 1802*a*, 1802*b* have been connected. The joiner structure comprises mount plate 1806 and a sleeve 1808. The mount plate is attached using screws, for example, to the fixtures 1802*a*, 1802*b*, and the sleeve 1808 wraps around to cover the interface. The extended modular fixture 1800 is a ceiling-mounted embodiment. However, it is understood that fixtures may be mounted using other methods, for example, wall-mount, surface-mount, or pendant-mount configurations. Such fixtures may be similarly joined together to create an extended modular fixture having a particular desired length.

It is understood that embodiments presented herein are meant to be exemplary. Embodiments of the present invention can comprise any combination of compatible features shown in the various figures, and these embodiments should not be limited to those expressly illustrated and discussed. Many other versions of the configurations disclosed herein are possible. Thus, the spirit and scope of the invention should not be limited to the versions described above.

We claim:

1. A modular light fixture, comprising:

a housing subassembly, comprising:

first and second end cap portions comprising receiving structures; and an external mount mechanism on a back surface of said housing subassembly;

a lighting subassembly distinct from said housing subassembly and comprising:

at least one light source, a back reflector comprising first and second ends, and an exit lens, a body comprising first and second ends, said at least one light source on a surface internal to said body, said back reflector contacting said exit lens at said first and second ends, wherein said back reflector faces said at least one light source such that substantially all light from said at least one light source first impinges on said back reflector before exiting said exit lens, an elongated heat sink that extends from said first end of said body to said second end of said body, said exit lens and said heat sink comprising the outermost surface of said lighting subassembly; and first and second end caps, said back reflector and said exit lens held between said first and second end caps, and driver electronics connected to control said at least one light source;

wherein said first and second end caps of said lighting subassembly are configured to mate with said receiving structures of said first and second end cap portions of said housing subassembly to removably attach said lighting subassembly to said housing subassembly such that an exterior surface of said housing subassembly is coplanar and aligned with an exterior surface of said lighting subassembly to give the appearance of a substantially continuous exterior surface, wherein, when said housing subassembly and said lighting subassembly are assembled, said surface internal to said body of said lighting subassembly on which said at least one light is disposed is spaced a distance from said external mount mechanism of said housing subassembly.

2. The modular light fixture of claim 1, wherein said housing subassembly further comprises:

an interior mount surface on which said driver electronics are mounted; and wherein said exit lens is attached to said body and configured to transmit at least a portion of light from said at least one light source.

3. The modular light fixture of claim 2, wherein said back reflector is an elongated back reflector which is proximate to said at least one light source.

4. The modular light fixture of claim 3, wherein said back reflector is diffusive.

5. The modular light fixture of claim 2, wherein said exit lens is diffusive.

6. The modular light fixture of claim 2, wherein said exit lens is prismatic.

7. The modular light fixture of claim 1, wherein said at least one internal surface is on a back side of said heat sink such that said at least one light source is mounted to said heat sink back side.

8. The modular light fixture of claim 1, wherein said lighting subassembly further comprises a motion sensor.

9. The modular light fixture of claim 1, wherein said driver electronics comprise:

an AC/DC converter;

a DC/DC converter; and a battery backup unit.

10. The modular light fixture of claim 1, wherein said light fixture provides a symmetric light output.

11. The modular light fixture of claim 1, wherein said light fixture provides an asymmetric light output.

12. The modular light fixture of claim 1, wherein said driver electronics are housed in said lighting subassembly.

13. The modular light fixture of claim 1, wherein said first and second end caps are on opposite ends of said fixture when said housing subassembly and said lighting subassembly are attached.

14. The modular light fixture of claim 1, further comprising an intermediate end cap at one end of said light fixture, said intermediate end cap comprising a joiner structure such that additional fixtures can be serially connected to form an extended modular light fixture.

15. A modular light fixture, comprising:

a housing subassembly comprising mount features on a back surface of said housing subassembly such that said back surface is directly mountable to an external structure and first and second end cap portions comprising receiving structures; and a lighting subassembly distinct from said housing subassembly and comprising:

at least one light source on an internal mount surface, a back reflector comprising first and second ends, an exit lens, said back reflector contacting said exit lens at said first and second ends, first and second end caps, said back reflector and said exit lens held between said first and second end caps, and driver electronics, wherein said driver electronics are fully enclosed by said lighting subassembly;

wherein said first and second end caps of said lighting subassembly are configured to meet with said receiving structures of said housing subassembly such that said housing subassembly and said lighting subassembly are removably attached such that an exterior surface of said housing subassembly is coplanar and aligned with an exterior surface of said lighting subassembly to give the appearance of a substantially continuous exterior surface, wherein said lighting subassembly comprises a hook and said housing subassembly comprises an eye such that said hook and said eye are configured to attach said subassemblies together, wherein, when said housing subassembly and said lighting subassembly are assembled, said internal mount surface of said lighting subassembly is spaced a distance from said back surface of said housing subassembly and said external structure, and wherein said housing subassembly and said lighting subassembly are removably attached with a swivel mechanism.

16. The modular light fixture of claim 15, wherein said housing subassembly comprises:

at least one feed hole through one of said end cap portion receiving structures, said at least one feed hole sized to accept a conduit for electric wires; and wherein said lighting subassembly further comprises:

a body defining an internal space; and an electronics compartment, said driver electronics housed within said electronics compartment.

17. The modular light fixture of claim 16, wherein said lighting subassembly body further comprises an elongated heat sink that extends from one end of said body to the other end.

18. The modular light fixture of claim 17, wherein said internal mount surface is on a back side of said heat sink such that said at least one light source is mounted to said heat sink back side.

19. The modular light fixture of claim 16, wherein said exit lens is diffusive.

20. The modular light fixture of claim 16, wherein said exit lens is prismatic.

21. The modular light fixture of claim 15, wherein said back reflector is an elongated back reflector which is proximate to said at least one light source.

22. The modular light fixture of claim 21, wherein said back reflector is diffusive.

23. The modular light fixture of claim 15, wherein said lighting subassembly further comprises a motion sensor.

24. The modular light fixture of claim 15, wherein said driver electronics comprise:

an AC/DC converter;

a DC/DC converter; and a battery backup unit.

25. The modular light fixture of claim 15, further comprising an intermediate end cap at one end of said light fixture, said intermediate end cap comprising a joiner structure such that additional fixtures can be serially connected to form an extended modular light fixture.

26. A modular light fixture, comprising:

a housing subassembly comprising:

first and second end cap portions comprising receiving structures; and an external mount mechanism on a back surface of said housing subassembly;

a lighting subassembly distinct from said housing subassembly, said housing and lighting subassemblies having associated widths which are substantially equal to the width of said modular light fixture, said lighting subassembly comprising:

a body;

a back reflector comprising first and second ends and at least partially surrounded by said body;

a heat sink comprising a back side mount surface;

a plurality of light sources on said back side mount surface, said back reflector facing opposite to a primary direction of emission of said light sources such that most of the light emitted from said light sources initially impinges on said back reflector;

a lens attached to said body, said lens configured to transmit at least a portion of light from said plurality of light sources, said back reflector contacting said lens at said first and second ends, said lens and said heat sink comprising the outermost surface of said lighting subassembly; and first and second end caps, said back reflector and said lens held between said first and second end caps; and driver electronics connected to control said plurality of light sources, wherein said driver electronics are at least partially enclosed by at least one of said housing subassembly or said lighting subassembly;

wherein said first and second end caps of said lighting subassembly are configured to mate with said receiving structures of said housing subassembly such that said housing subassembly and said lighting subassembly are removably attached, wherein, when said housing subassembly and said lighting subassembly are assembled, said back side mount surface of said lighting subassembly is spaced a distance from said external mount mechanism of said housing subassembly.

27. The modular light fixture of claim 26, wherein said lens is diffusive.

28. The modular light fixture of claim 26, wherein said lens is prismatic.

29. The modular light fixture of claim 26, wherein said lighting subassembly further comprises a motion sensor.

30. The modular light fixture of claim 26, wherein said driver electronics comprise:

a power converter; and a battery backup unit.

31. The modular light fixture of claim 26, further comprising an intermediate end cap at one end of said light fixture, said intermediate end cap comprising a joiner structure such that additional fixtures can be serially connected to form an extended modular light fixture.

32. An extendable linear fixture, comprising:

a plurality of modular fixtures, each of said modular fixtures comprising:

a housing subassembly comprising:

mount features on a back surface of said housing subassembly such that said back surface is directly mountable to an external structure; and first and second end cap portions comprising receiving structures; and a lighting subassembly distinct from said housing subassembly and comprising at least one light source on an internal mount surface, a back reflector, an exit lens, and first and second end caps, said back reflector and said exit lens held between said first and second end caps;

wherein said first and second end caps of said lighting subassembly are configured to meet with said receiving structures of said housing subassembly such that said housing subassembly and said lighting subassembly are removably attached such that an exterior surface of said housing subassembly is coplanar and aligned with an exterior surface of said lighting subassembly to give the appearance of a substantially continuous exterior surface; and at least one joiner structure, one of said joiner structures between adjacent ones of said modular fixtures and connecting said modular fixtures together at an interface, wherein said at least one joiner structure covers said interface and at least a portion of the exit lenses of said adjacent modular fixtures;

wherein, when said housing subassembly and said lighting subassembly are assembled, said internal mount surface of said lighting subassembly is spaced a distance from said back surface of said housing subassembly and said external structure, wherein said housing subassembly and said lighting subassembly are removably attached with a swivel mechanism.

33. The extendable linear fixture of claim 32, wherein said swivel mechanism comprises:

a set of flanges on said housing subassembly; and a set of clips on said lighting subassembly;

said flanges corresponding to said clips such that, when said clips are hooked over said flanges, said lighting assembly is suspended from said housing assembly.

* * * * *